US007246650B2

(12) United States Patent
Peterson

(10) Patent No.: US 7,246,650 B2
(45) Date of Patent: Jul. 24, 2007

(54) ENHANCED GRAVITY CASTING

(75) Inventor: Norman E. Peterson, Wyoming, MN (US)

(73) Assignee: Water Gremlin Company, White Bear Lake, MN (US)

( * ) Notice: Subject to any disclaimer, the term of this patent is extended or adjusted under 35 U.S.C. 154(b) by 32 days.

(21) Appl. No.: 11/168,280

(22) Filed: Jun. 28, 2005

(65) Prior Publication Data

US 2005/0241795 A1 Nov. 3, 2005

Related U.S. Application Data

(62) Division of application No. 10/673,710, filed on Sep. 29, 2003, now Pat. No. 6,997,234.

(51) Int. Cl.
*B22D 17/04* (2006.01)

(52) U.S. Cl. ..... 164/312; 164/306; 164/322

(58) Field of Classification Search ..... 164/113, 164/312, 119, 322, 319
See application file for complete search history.

(56) References Cited

U.S. PATENT DOCUMENTS 6,564,853 B1 * 5/2003 Ratte ..... 164/113

FOREIGN PATENT DOCUMENTS

| | | |
|---|---|---|
| CH | 321596 A | 5/1957 |
| FR | 2504424 | 10/1982 |
| GB | 1257963 A | 12/1971 |

* cited by examiner

*Primary Examiner*—Len Tran
(74) *Attorney, Agent, or Firm*—Jacobson & Johnson

(57) ABSTRACT

An apparatus and method for enhanced gravity casting wherein a portion of the mold is maintained in pressure contact with molten metal as it solidifies to allow the mold surface to follow the contraction of the solidifying metal. A further feature of the invention is the use of an air clearance between mold parts that is sufficient to allow air to escape but insufficient to allow molten metal to flow therepast.

7 Claims, 2 Drawing Sheets

ENHANCED GRAVITY CASTING

This application is a division, of application Ser. No. 10/673,710 filed Sep. 29, 2003 now U.S. Pat. No. 6,997,234.

FIELD OF THE INVENTION

This invention relates to gravity casting and more specifically to enhanced gravity casting of a molten metal.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

The casting of molten metal and particularly molten metals such as molten lead for battery parts is done under different casting conditions. One of the casting methods is high pressure intensification which involves increasing the pressure of molten lead in the cavity by driving a piston into the molten metal to substantially increase the pressure. This process of intensification is described more fully in Ratte U.S. Pat. Nos. 6,202,733; 6,363,996; 6,405,786; 6,499,530; 6513,570; 6,598,658 and 6,564,853 and uses pressures that compress the metal to reduce the volume of air bubbles in the metal.

Another method of casting battery parts is gravity casting. Gravity casting is preferred for casting larger parts that cool slowly because the gravity casting allows the molten metal to slowly flow under the pressure of gravity to fill any voids in mold cavity as the molten metal solidifies. This results in a part that is substantially free of cracks and voids. Gravity casting uses the head pressure generated by the molten metal to fill out the mold cavity. Thus gravity casting is done at a low fluid pressure within the molten metal. In certain applications, such as larger parts that are immersed in an acid, a gravity cast battery part is highly desirable since the molten metal flows and fills during the solidification process thus virtually eliminating solidification cracks and stresses in the battery part. Since cracks and stresses in a battery part, which is immersed in an acid, can cause rapid deterioration of the battery part it is generally preferred to gravity cast large articles if the article is located in an acid such as found in a battery. However, one of the disadvantages of gravity cast articles is that the articles generally lack the surface definition of high pressure injection molded parts.

The present invention provides an enhanced gravity casting process wherein the molten metal is allowed to solidify under gravity casting conditions while at the same time a follower, which is a portion of the mold surface, is maintained under a following pressure to follow the volume contraction of the molten metal as the molten metal solidifies. That is, as the metal shrinks during solidification the pressure on the molten metal is maintained so that the mold surface or follower moves toward the mold cavity in response to the shrinkage due to solidification. A further feature of the invention is that at the same time air is allowed to escape from the molten metal through a passage which is sufficiently small that molten lead does not flow therepast.

SUMMARY OF THE INVENTION

An apparatus and method for enhanced gravity casting wherein a portion of the mold is maintained in following pressure contact with molten metal as it solidifies to allow the mold surface to follow the contraction of the solidifying metal. A further feature of the invention is the use of clearance between mold parts that is sufficient to allow air to escape but insufficient to allow molten metal to flow therepast.

DESCRIPTION OF THE PREFERRED EMBODIMENT

Figure 1:
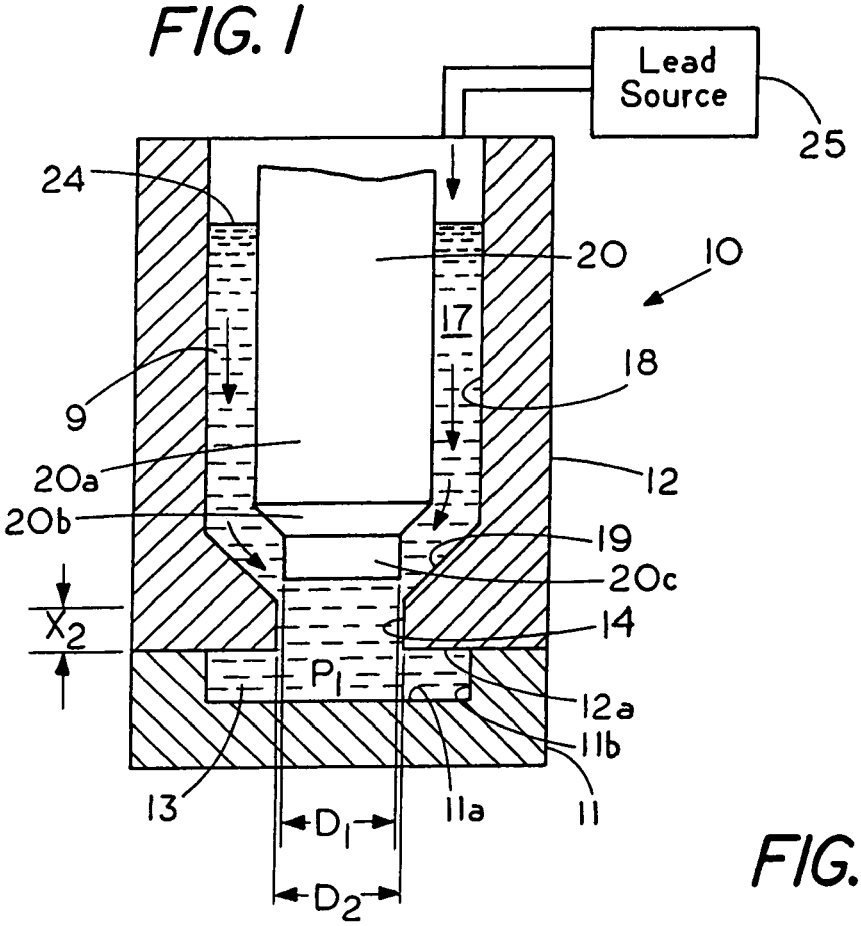
FIG. 1 is a sectional view of a gravity casting apparatus in a mold filling condition.

FIG. 1 is a sectional view showing the enhanced gravity casting apparatus 10 comprising a lower mold part 11 and an upper mold part 12 or housing that define a mold cavity 13. That is, mold part 12 includes a fixed mold surface 12*a* that defines a portion of the top of mold cavity 13 and mold part 11 includes a bottom mold surface 11*a* that defines the bottom portion of mold cavity 13 and a side mold surface 11*b* that defines the sides of mold cavity 13. Upper mold part 12 includes a cylindrical inlet passage 14 therein to allow molten metal to flow from a molten metal holding chamber 17 formed in mold part 12. Chamber 17 comprises an open top chamber with a cylindrical sidewall 18 and a converging sidewall or shoulder 19 that connects with an inlet passage 14 to direct molten lead in chamber 17 into the mold cavity 13 under gravity pressure.

Located within chamber 17 is a shutoff member 20 or movable mold part having a cylindrical upper portion 20*a*, a converging portion or shoulder 20*b* and a lower cylindrical portion 20*c*. The diameter of the lower portion 20*c* is identified by $D_1$ and the diameter of the inlet passage 14 is designated by $D_2$. FIG. 1 shows the movable mold part 20 in the gravity castings condition wherein molten lead 9 is allowed to flow from chamber 17 into the bottom mold cavity 13 under the influence of gravity.

Reference number 24 defines the fluid interface between the molten metal 9 and the air or gas atmosphere above the molten lead. A lead source 25 supplies molten lead to the chamber 17 to maintain a level of molten lead in the chamber 17 so that molten lead can flow into the mold cavity under the gravity pressure on the molten lead. FIG. 1 identifies the pressure $P_1$ of the molten lead in the mold cavity. The pressure $P_1$ is due to the head of molten lead above the mold cavity 13.

As can be seen in FIG. 1, the shutoff member 20 is maintained at least partially submerged in the molten lead 9 in chamber 17 and in a spaced condition from the inlet passage 14. It should be understood that the reference to molten lead herein is meant to include lead and lead alloys. As shown in FIG. 1, the molten lead 9 is free to flow into cavity 13 from chamber 17 under the pressure of gravity.

Thus, the first step in the method of enhanced gravity casting includes directing a charge of molten lead 9 into a chamber 17 located in fluid communication with a battery part cavity 13 to generate a gravity pressure on the molten metal, which allows the battery part cavity 13 to fill with molten lead 9 under a gravity flow condition.

This method is particularly useful with large casting and particularly useful with those castings that weight many pounds or have such configurations that the molten lead needs to solidify slowly. As can be seen in FIG. 1, the molten lead 9 is allowed to fill the mold cavity 13 under the gravity pressure on the molten lead.

Figure 2:
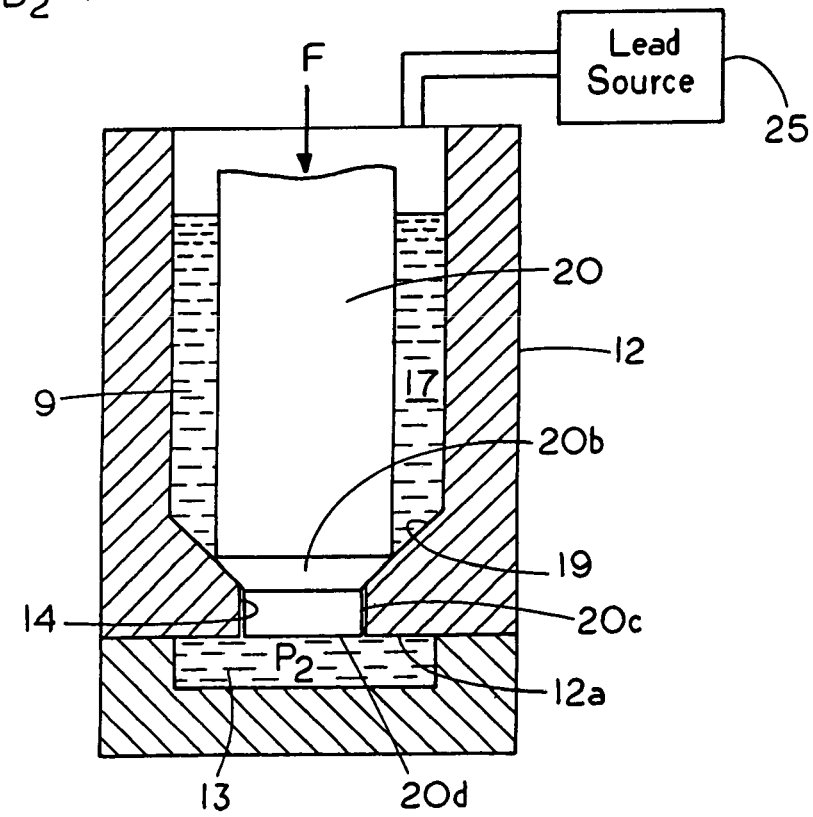
FIG. 2 is the sectional view of the gravity casting apparatus of FIG. 1 in a closed condition.

FIG. 2 illustrates the movable mold part in the solidification or closed condition wherein the mold cavity end surface 20*d* of shutoff member 20 preferably forms a continuous part of the mold surface with mold surface 12*a* to define the mold cavity 13 therein. In the solidification condition the moveable mold part 20 remains at least partially immersed in the bath of molten lead 9 with end mold surface 20*d* of movable mold part 20 forming a closure for the mold cavity 13. In this condition shutoff member 20 is located in the molten lead in chamber 17 and the shutoff member surface 20*c* is in engagement with a mold inlet passage 14 while the molten lead remains in a liquid state 9. The engagement of the member 20*c* with the inlet passage 14 prevents further gravity flow of molten lead into the mold cavity 13. In the position shown shoulder 19 functions as a stop for shoulder 20*b* to prevent further downward movement of member 20. In the preferred position the end face 20*d* is substantially coextensive with mold face 12*a* and is prevented from moving into cavity 13 due to the engagement of shoulder 20*b* and 19.

Figure 3:
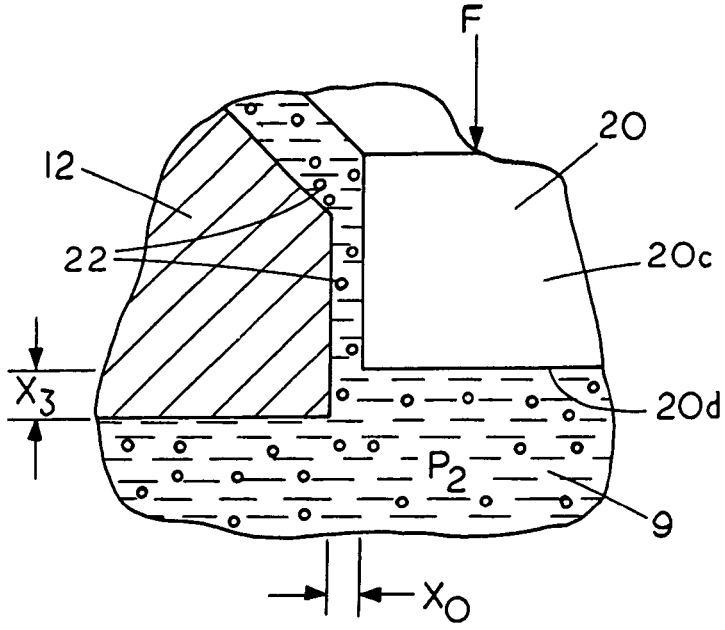
FIG. 3 is an enlarged partial view showing the relationship between a mold inlet passage and a movable mold part.

FIG. 3 is an enlarged partial cross sectional view showing the relationship of the shutoff member 20 and particularly cylindrical surface 20*c* in relation to the inlet passage 14. In the embodiment shown the movable mold part 20 is maintained in pressure contact with the molten lead 9 through a following force F on the movable mold part 20. The pressure of the metal in the mold cavity is indicated by $P_2$. In this condition, the pressure of the metal in the mold $P_2$ is balancing the following force F on the moveable mold part. As the molten metal solidifies and shrinks the pressure $P_2$ decreases causing the mold part 20 to be forced downward until the mold pressure again rises to the level $P_2$ to balance with following force F. Thus, by maintaining a constant following force F on the mold part 20 the mold face 20*d* can follow the solidification volume contraction of the metal during the solidification process. In the preferred method, upon solidification, the following force F and the time of shutoff are adjusted such that the mold surface 20*d* is in substantial alignment with mold surface 12*a*. By following force it is meant that the following force F is sufficient so as to cause the mold surface to move toward the cavity in response to the shrinkage of the metal during solidification but the following force is generally insufficient to compress and deform the metal beyond the internal volume shrinkage that normally occurs during gravity casting. Thus, in the present process the volume of individual air bubbles remaining in the molten metal remain substantially the same since the article is not subject to intensification pressures. However, the present process can also provide for a decrease in the mass of air in the gravity casting by allowing air to escape from the solidifying casting.

Thus, a further feature of the invention is the clearance between the inlet passage 13 of mold part 12 and the movable old part surface 20*c*, which is indicated by $X_o$ in FIG. 3. The clearance $X_o$ is maintained sufficiently small so that the molten lead does not flow therethrough but sufficiently large so that air in the molten lead can escape therepast. Typically, under gravity casting conditions with molten lead, an air or gas clearance of about 0.005 inches or less is sufficient clearance to allow air bubbles in the molten lead to escape from the solidifying metal but insufficient to allow molten lead to flow therepast. However, the actual amount of air clearance can vary depending on the shape of the surfaces. In contrast a liquid clearance for a molten metal such as lead or the like to flow therepast is substantially higher under gravity casting conditions.

Figure 4:
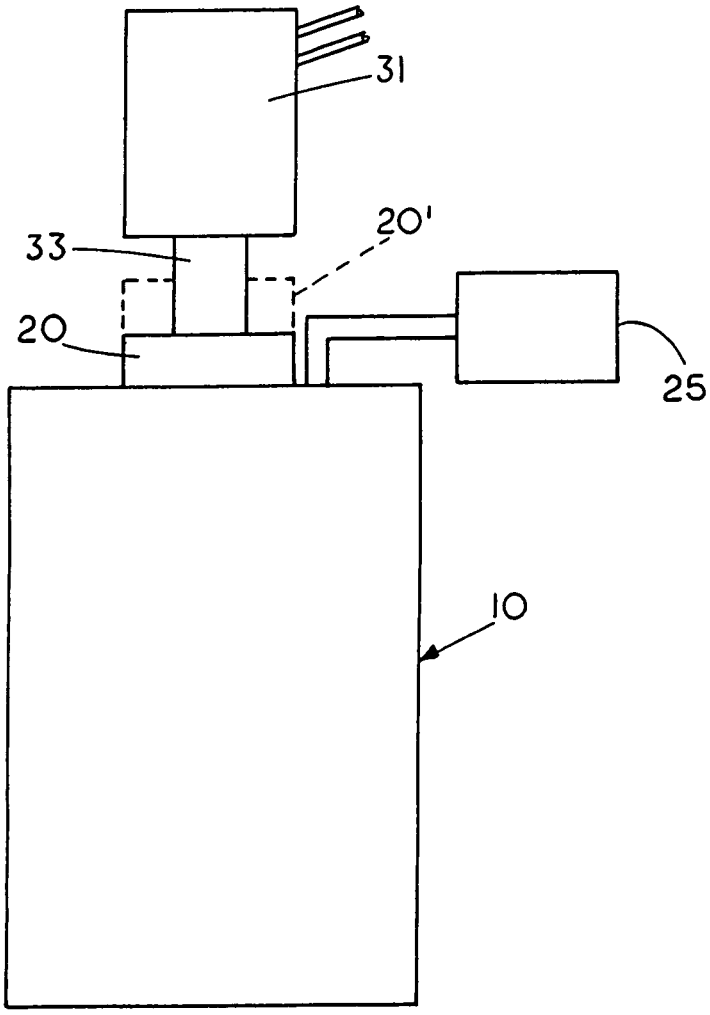
FIG. 4 is a partial schematic view of an apparatus for enhanced gravity casting of an article.

FIG. 4 shows a view of the present invention wherein the gravity casting apparatus 10 is supplied by molten metal from a source 25 and a two way cylinder 31 having an extendible and retractable arm 33 is shown in engagement with movable mold part 20. Gravity casting apparatus 10 is shown in the down condition or the condition wherein following force F is maintained on member 20 as illustrated in FIG. 2. The dashed lines, which are indicated by 20', show the movable mold part 20 in the retracted or open condition as illustrated in FIG. 1.

Thus in the present invention includes a method of enhanced gravity casting by directing a charge of molten lead into a chamber 17 located in fluid communication with a battery part cavity 13. Next one allows the battery part cavity 13 to fill with molten lead under a gravity flow condition. Once filled one extends a shutoff member 20 located in the molten lead 9 in the chamber 17 into engagement with a mold inlet passage 14 while the molten lead is in a liquid state to close off the inlet passage 14 and prevent further gravity flow of molten lead into the mold cavity 13. By maintaining sufficient following pressure on the shutoff member 20 through member 31 as the molten lead 9 solidifies it allows the shutoff member to follow a solidification volume contraction of the molten lead 9 in the mold cavity 13 to thereby form an enhanced gravity casting where the surfaces features are have high definition and detail.

In the preferred method the end face 20*d* of shutoff member 20 is brought into substantial alignment with a face 12*a* of the mold cavity 13 as the volume contraction occurs during the solidification of the molten lead in the battery part cavity by determining the amount of expected volume contraction during the solidification phase.

By forming the shutoff member with a diametrical dimension less than the dimension of the chamber 17, when the shutoff member is in the closed condition, the molten lead can remain in a molten state surrounding the shutoff member 20 and in position where the molten metal can be directed into the mold cavity 13 after the solidified part is removed from the mold cavity 13.

By maintaining the shutoff member 20 and the inlet passage 14 with sufficient air clearance $X_o$ to permit air to escape from the molten lead in the cavity but insufficient to permit molten lead to escape therepast one can allow air to escape from the molded part and thereby provide a more dense casting without having to compress the air bubbles in the cast part.

In the present process one applies a following force F to the shutoff member through a moveable piston 31 or the like and positions the mold the mold inlet passage 14 on a top side of the battery part cavity 13. In the preferred method the following force F, which is sufficient to cause the mold surface to follow the volume contraction of the solidifying metal, is maintained on the solidifying part when the molten metal is in a liquid state and continues until the solidification process is complete. Thus in the present invention an internal volume reduction due to shrinkage is solely compensated by maintaining a following force on the molten lead until the molten lead solidifies.

A further feature of the invention is that the second mold part is located at least partly in a chamber of molten lead with the chamber 17 in fluid communication with the mold cavity 13 and the molten lead 9 in the chamber maintainable in a molten state to permit gravity casting of a second article by removing a first cast part from the mold cavity and replacing the mold part with an empty mold cavity below the chamber.

I claim:

1. An apparatus for enhanced gravity casting comprising:

a housing;

a molten lead holding chamber in said housing;

an inlet passage in said housing, said inlet passage located in fluid communication with said chamber in said housing;

a mold part, said mold part having a battery part cavity therein, said mold part having an opening for ingress of a molten lead therein;

a movable mold part, said moveable mold part having an end face and a sidewall, said sidewall engageable with the inlet passage to capture molten lead in the cavity and prevent flow of molten lead to or from the cavity, said movable mold part end face maintainable in contact with a portion of the molten lead in the cavity under a following force to cause the movable mold part end face to move toward the cavity to reduce a mold cavity volume in response to the molten lead solidification contraction wherein the movable mold part has a first diameter and the inlet has a second diameter with a diametrical difference between the first diameter and the second diameter of about 0.005 inches to allow air to flow out while preventing lead from flowing therepast.

2. The apparatus of claim 1 including a member for maintaining a constant following force on the movable mold part to allow the moveable mold part to move in response to the molten lead solidification contraction.

3. The apparatus of claim 1 wherein the moveable mold part is located at least partly below a molten lead interface with a surrounding atmosphere.

4. An apparatus for enhanced gravity casting comprising:

a housing;

a molten lead holding chamber in said housing;

an inlet passage in said housing, said inlet passage located in fluid communication with said chamber in said housing;

a mold part, said mold part having a battery part cavity therein, said mold part having an opening for ingress of a molten lead therein;

a movable mold part, said moveable mold part having an end face and a sidewall, said sidewall engageable with the inlet passage to capture molten lead in the cavity and prevent flow of molten lead to or from the cavity, said movable mold part end face maintainable in contact with a portion of the molten lead in the cavity under a following force to cause the movable mold part end face to move toward the cavity to reduce a mold cavity volume in response to the molten lead solidification contraction; and the moveable mold part includes a shoulder and the mold part includes a shoulder for limiting contraction of the volume of molten lead in the cavity.

5. A mold for enhanced gravity casting comprising:

a first mold part having a mold cavity, said first mold part having a top inlet passage;

a chamber for holding a molten lead, said chamber positioned above said top inlet passage to permit a gravity flow of the molten lead into the mold cavity;

a second mold part having a shoulder for limiting contraction of the molten lead in the mold cavity, said second mold part having an end plug engageable with said inlet passage, said end plug and said inlet passage having an air clearance therebetween to permit air in the molten lead in the cavity to escape but the air clearance insufficient to permit molten lead to escape from the mold cavity when in an engageable condition; and a member for maintaining a downward following force on said second mold part to allow a mold surface on said second mold part to move toward the mold cavity as the air escapes from the molten lead in the cavity.

6. The apparatus of claim 5 wherein the movable mold part is located at least partly in the molten lead in the molten lead holding chamber.

7. The apparatus of claim 5 wherein the second mold part is located at least partly in a chamber of molten lead with the chamber in fluid communication with the mold cavity and the molten lead in the chamber maintainable in a molten state to permit gravity casting of a second article by removing a first cast part and replacing the mold part below the chamber.

* * * * *